US005934785A

United States Patent [19]

Chen

[11] Patent Number: 5,934,785

[45] Date of Patent: Aug. 10, 1999

[54] STRUCTURE OF A LIGHT

[76] Inventor: Ching-Ming Chen, P.O. Box 82-144, Taipei, Taiwan

[21] Appl. No.: 08/998,227

[22] Filed: Dec. 24, 1997

[51] Int. Cl.[6] ..... F21V 3/00

[52] U.S. Cl. ..... 362/124; 362/808

[58] Field of Search ..... 362/124, 363, 362/806, 808, 249

[56] References Cited

U.S. PATENT DOCUMENTS

| | | | |
|---|---|---|---|
| 4,452,836 | 6/1984 | Daniel, Jr. | 362/806 X |
| 4,833,580 | 5/1989 | Allen | 362/806 X |
| 4,989,120 | 1/1991 | Davis et al. | 362/124 X |
| 5,361,192 | 11/1994 | Lai | 362/806 X |
| 5,436,817 | 7/1995 | Wotton et al. | 362/124 X |
| 5,599,092 | 2/1997 | Yen | 362/806 X |

*Primary Examiner*—Laura K. Tso
*Attorney, Agent, or Firm*—A & J

[57] ABSTRACT

A decorative light includes a spherical housing having an upper end formed with a circular neck, a plastic socket arranged in the circular neck of the spherical bulb, a light bulb fixedly fitted in the plastic socket, an electric cord having an end extending through the plastic socket into the spherical housing to connect with the light bulb and another end connected with an electrical plug, and a doll having an open bottom mounted on an upper portion of the spherical housing, the doll having a top provided with a ring engaged with a string, whereby the decorative light is appealing and fascinating in appearance thus enabling it to be used for decorating.

1 Claim, 3 Drawing Sheets

STRUCTURE OF A LIGHT

BACKGROUND OF THE INVENTION

1. Field of the Invention

This invention is related to an improvement in the structure of a light and in particular to one which can be used for decorating.

2. Description of the Prior Art

Traditionally, people will hang some decorations and lights on a Christmas tree for celebrating Christmas. However, the conventional Christmas light is simply a plastic socket on which is mounted an electric light bulb thereby flaking it look very dull and undesirable.

Therefore, it is an object of the present invention to provide an improved light which is appealing and fascinating in appearance.

SUMMARY OF THE INVENTION

This invention is related to an improvement in the structure of a light.

It is the primary object of the present invention to provide an improved light which looks appealing and fascinating.

It is another object of the present invention to provide an improved light which can be used for decorating.

It is still another object of the present invention to provide an improved light which is easy to assemble.

It is still another object of the present invention to provide an improved light which is simple in construction.

It is a further object of the present invention to provide an improved light which is low in cost.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numberals refer to identical or similar parts.

DETAILED DESCRIPTION OF THE PREFERRED EMBODIMENT

Figure 1:
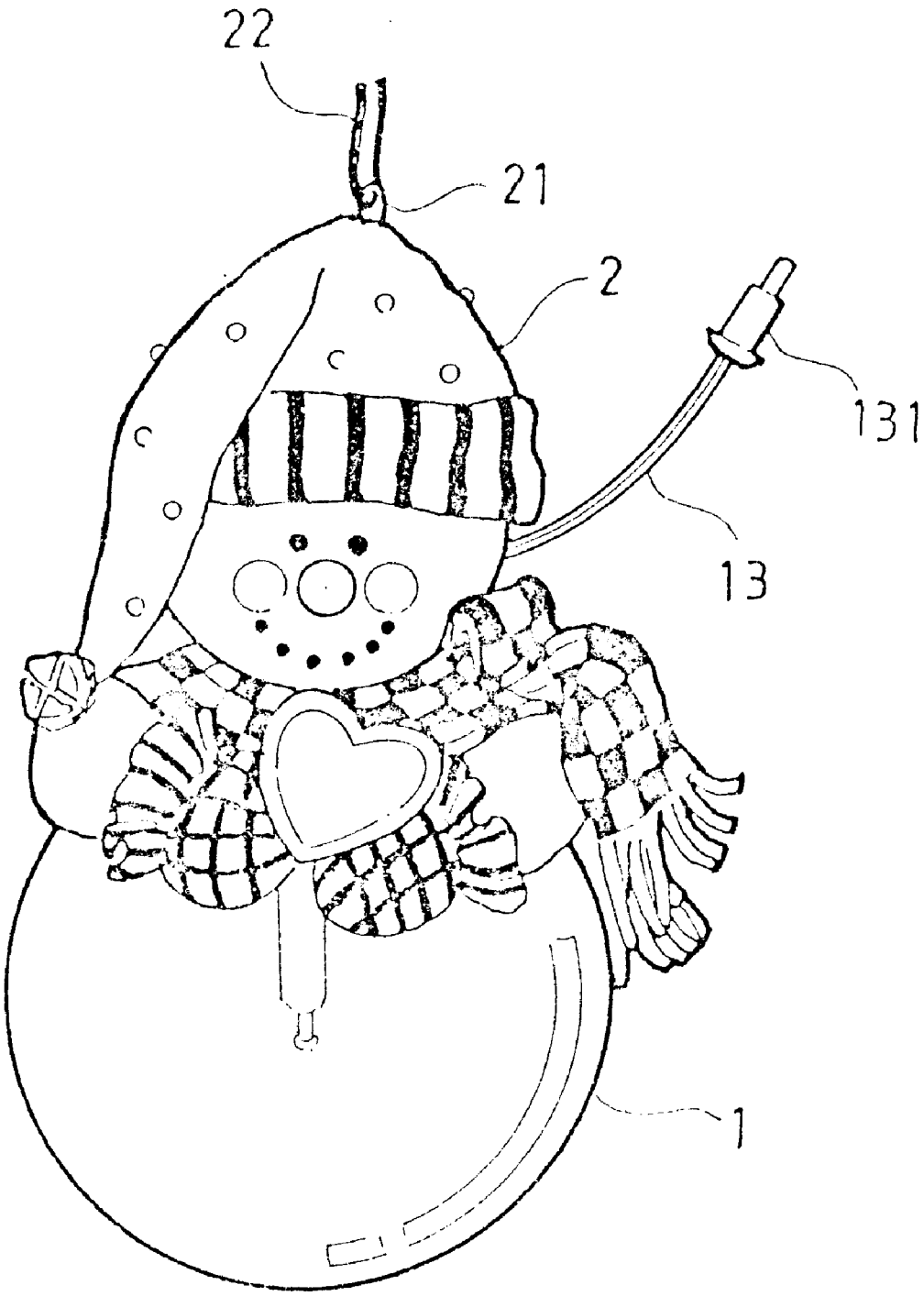
FIG. 1 is a perspective view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
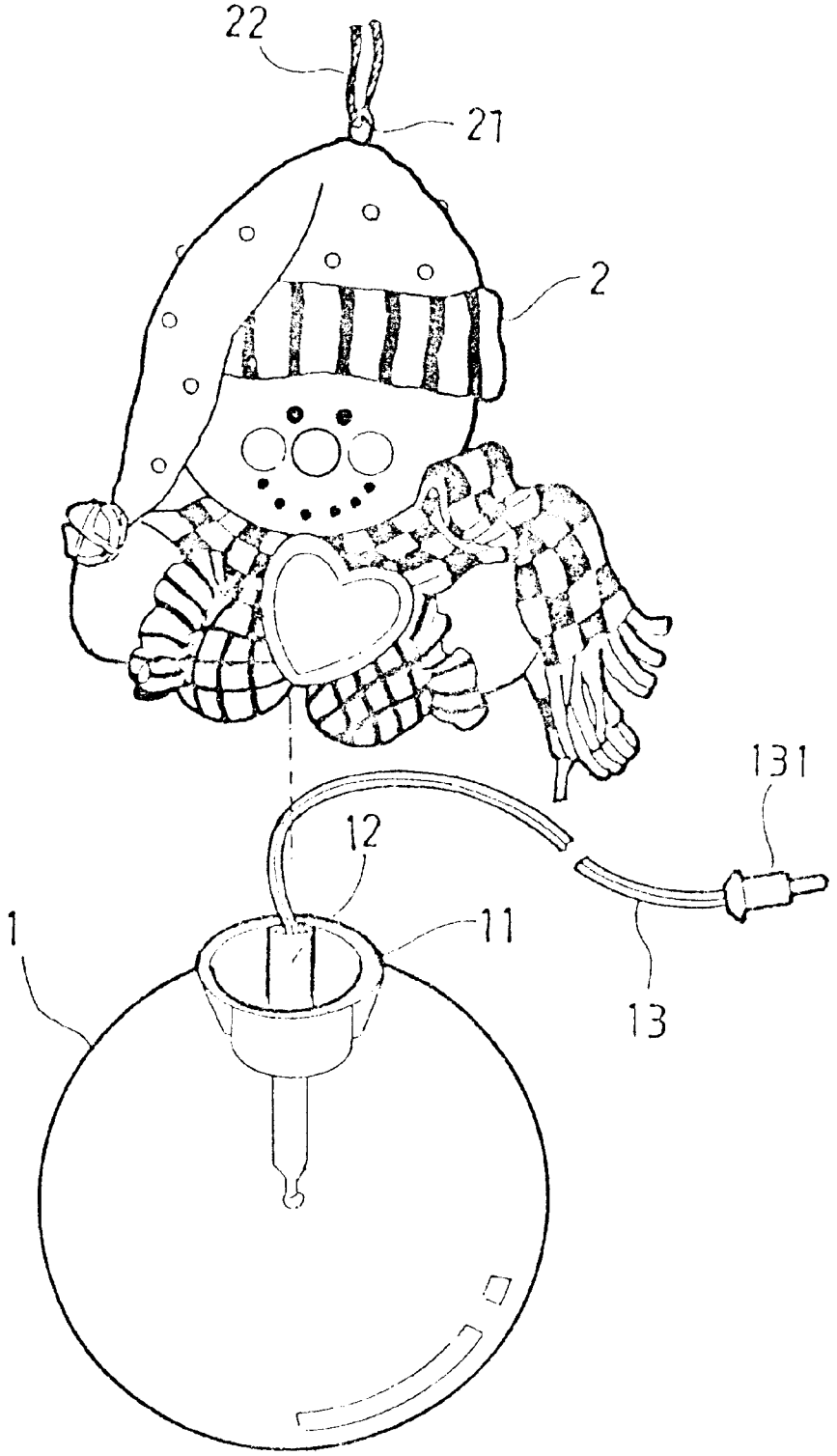
FIG. 2 is an exploded view of the present invention.

With reference to the drawings and in particular to FIGS. 1 and 2 thereof, the light according to the present invention comprises a spherical housing 1 formed with a circular neck 11 at the upper end. A plastic socket 12 is arranged in the circular neck 11 of the spherical housing 1. A light bulb (shown but not numbered) is fixedly fitted in the plastic socket 12. An electric cord 13 has an end extending through the plastic socket 12 into the spherical housing 1 to connect with the light bulb. The other end of the electric cord 13 is connected with an electrical plug 131.

A doll 2 made of colored clay, poly or the like is mounted on the upper portion of the spherical housing 1. The doll 2 has an open bottom so that the upper portion of the spherical housing 1 is covered by the doll 2. The doll 2 is provided at the top with a ring 21 for engaging with a string 22 so that the present invention can be hung on a Christmas tree or the like. Furthermore, when the electrical plug 131 is inserted into an outlet (not shown), the light bulb will give light thereby making the present invention look appealing and fascinating.

Figure 3:
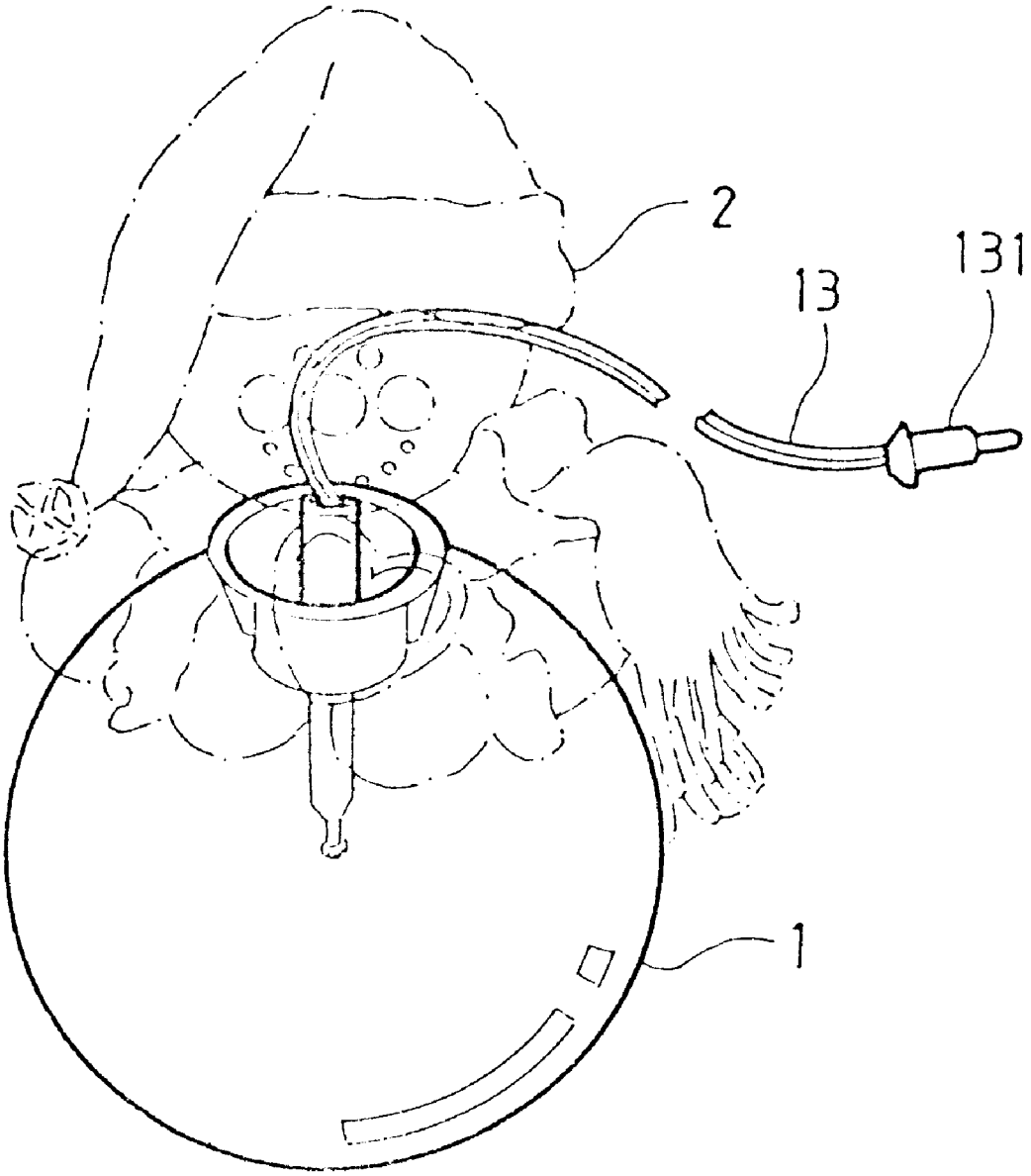
FIG. 3 illustrates the structure of the present invention.

As shown in FIG. 3, the interior of the doll 2 is made hollow, so that the doll 2 can be conveniently fixedly mounted on the upper portion of the spherical housing 1 and will give light when the electrical plug 131 is inserted into an outlet.

The invention is naturally not limited in any sense to the particular features specified in the foregoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A decorative light comprising:

a spherical housing having an upper end formed with a circular neck;

a plastic socket arranged in said circular neck of said spherical bulb;

a light bulb fixedly fitted in said plastic socket;

an electric cord having an end extending through said plastic socket into said spherical housing to connect with said light bulb and another end connected with an electrical plug; and a doll having an open bottom mounted on an upper portion of said spherical housing, said doll having a top provided with a ring engaged with a string.

* * * * *